United States Patent [19]

Dalebout et al.

[11] Patent Number: 5,058,882

[45] Date of Patent: Oct. 22, 1991

[54] STEPPER EXERCISER

[75] Inventors: William T. Dalebout; Kim B. Liechty, both of Logan; Scott R. Watterson, River Heights, all of Utah

[73] Assignee: Proform Fitness Products, Inc., Logan, Utah

[21] Appl. No.: 482,224

[22] Filed: Feb. 20, 1990

[51] Int. Cl.[5] ..... A63B 23/04

[52] U.S. Cl. ..... 272/70; 272/130

[58] Field of Search ..... 272/69, 70, 72, 73, 272/97, 125, 126, 130, 131, 132, 133, 134, 143, DIG. 9

[56] References Cited

U.S. PATENT DOCUMENTS

| | | | |
|---|---|---|---|
| 3,731,921 | 5/1973 | Andrews, Jr. | 272/132 X |
| 3,970,302 | 7/1976 | McFee | 272/70 X |
| 4,546,970 | 10/1985 | Mahnke | 272/134 X |
| 4,659,075 | 4/1987 | Wilkinson | 272/70 |
| 4,838,543 | 6/1989 | Armstrong et al. | 272/70 |
| 4,850,585 | 7/1989 | Dalebout | 272/70 |
| 4,909,504 | 3/1990 | Yang | 272/70 X |
| 4,934,690 | 6/1990 | Bull | 272/70 |
| 4,940,233 | 7/1990 | Bull et al. | 272/130 |

FOREIGN PATENT DOCUMENTS

| | | | |
|---|---|---|---|
| 45140 | 11/1888 | Fed. Rep. of Germany | 272/70 |
| 523174 | 4/1931 | Fed. Rep. of Germany | 272/70 |
| 2416778 | 10/1974 | Fed. Rep. of Germany | 272/70 |
| 2919494 | 11/1980 | Fed. Rep. of Germany | 272/97 |
| 2007987 | 5/1979 | United Kingdom | 272/70 |

*Primary Examiner*—Robert Bahr

*Attorney, Agent, or Firm*—Trask, Britt & Rossa

[57] ABSTRACT

A stepper exercise machine has a pair of spaced apart levers pivotally secured to the upright portion of a frame. Handles are secured to the frame in a first configuration to form an enclosure for the user. The handles may be moved to a second configuration in which they each are secured to a lever for movement therewith. The stepper also has structure to resist movement of the levers and to cause the levers to reciprocate.

27 Claims, 4 Drawing Sheets

STEPPER EXERCISER

BACKGROUND OF THE INVENTION

1. Field

This invention relates to exercise apparatus and particularly to an apparatus for performing climbing/stepping type exercises.

2. State of the Art

The climbing of stairs has long been recognized as a beneficial exercise which contributes to physical conditioning, including improved cardiopulmonary function. The exercise of the legs contributes to improved muscle tone of the lower extremities. However, use of the arms in such exercises is typically limited. There are various devices which allow an exerciser to simulate such exercises in a restricted space.

Stepping exercisers are known to perform stair climbing-type exercises. For example, U.S. Pat. No. 4,733,858 (Lan) shows a device with trolleys that move on a slanted track to simulate stair climbing. U.S. Pat. No. 4,708,338 (Potts) shows a device with treadles for performing stepping-type exercises. U.S. Pat. No. 4,681,316 (deCloux) and 4,659,075 (Wilkinson) show other climbing and stepper exercise structures. The SUMMIT climber made by Weslo, Inc. of Logan, Utah, includes handgrips so the user may exercise the arms in a climbing manner.

SUMMARY OF THE INVENTION

An exercising device has frame means for positioning on a support surface. First and second lever means are pivotally mounted to the frame means for operation by a user in an upright position thereon. Resistance means is mechanically associated with the lever means to resist movement thereof. The exercising apparatus has first handle means for grasping by the user. The first handle means is positionable in either a first configuration wherein the first handle means is secured to the frame means, or a second position wherein the first handle means is attached to the first lever means for movement therewith.

Preferably, the exercising device has second handle means for grasping by the user which is also positionable in a first configuration in which it is attached to the frame means and a second configuration in which it is attached to the second lever means for movement therewith.

In one embodiment, the exercising device includes synchronizing means connected to and between the first and second lever means for causing movement of the first lever means relative to the second lever means. Desirably, the synchronizing means includes guide means secured to the frame means with cable means trained thereabout and having one end secured to first lever means and the other end secured to the second lever means.

The resistance means may include a first and second hydraulic resistance cylinder, each interconnected between the frame means and its respective lever means. In another embodiment, the first and second hydraulic resistance cylinders are attached to the first and second lever means by first and second attaching means, respectively, to vary the resistance to movement by the first and second resistance cylinders. The first and second attaching means are each slots formed in the first and second lever means respectively. The first and second hydraulic resistance cylinders have coacting means to move along the length of the slots to vary the resistance to movement.

In a preferred arrangement, the first and second handle means each have handle sections for grasping by the user. The first and second lever means are preferably treadles pivotally mounted at one end thereof to the frame means. The first and second handle means are attached in both configurations by handle attaching means. Preferably, the handle attaching means includes recesses formed in the lever means and the frame means to receive the ends of the first and second handle means.

In a desired embodiment, the upper section of the first handle means has a first member which extends away from the frame means and a second member connected thereto which extends toward the user. The upper section is preferably formed to be "L"-shaped in projection with upper connection means at one end of the first member to connect to the frame means in the first configuration. The lower section may be connected to the second member of the upper section. Lower connection means are provided for connection of the first lever means to the lever means in the second configuration. The lower connection means may also provide for connection to the frame means in said first configuration. The second handle means may also have an upper section which is "L" shaped in projection to form together with the first handle means a "C"-shaped enclosure about the user in an upright position on the first and second lever means.

In one configuration, a hydraulic cylinder is interconnected between the frame means and one of the lever means. The hydraulic cylinder may have a channel for flow of fluid to and from opposite sides of an internal piston. A valve may be positioned in the channel to regulate flow therethrough and in turn the resistance imparted by the hydraulic cylinder.

In yet another configuration, the synchronizing means includes a guide above and a guide below the lever members. A cable is trained about the guides and connected to the levers which are interconnected thereto. The lower portion of the cable connected between the lever members is a strap. The lower guide is an elongated pin about which the strap is trained.

BRIEF DESCRIPTION OF THE DRAWINGS

In the drawings, which illustrate what is presently regarded as the preferred embodiment.

DETAILED DESCRIPTION OF THE DRAWINGS

Figure 1:
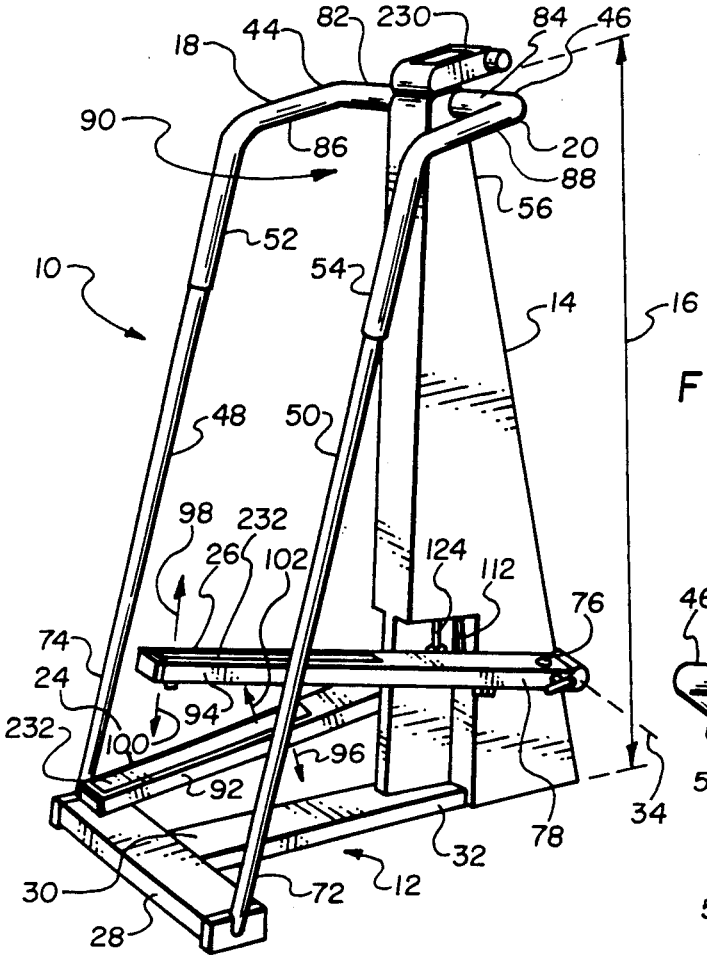
FIG. 1 is a perspective view of an exercising device of the invention in a first configuration.
Figure 2:
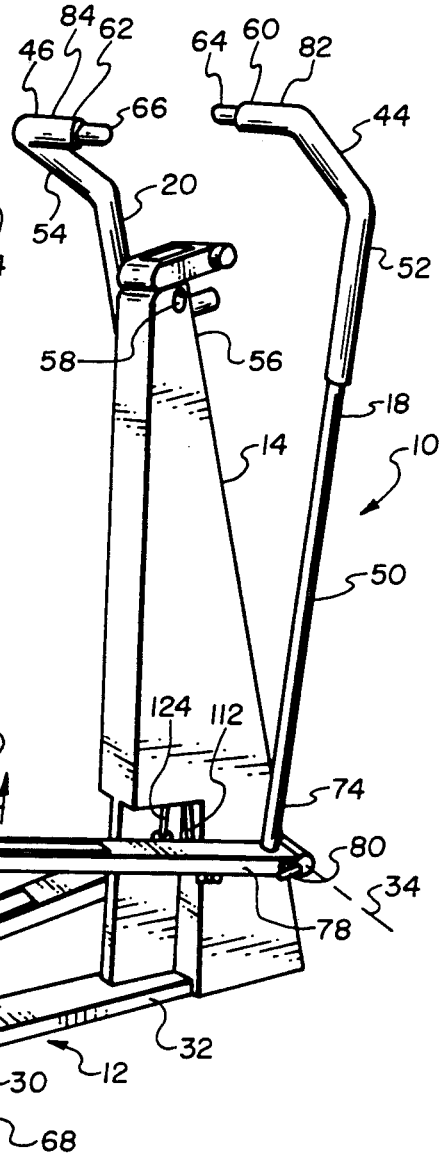
FIG. 2 is a perspective view of the exercising device of FIG. 1 in a second configuration.

FIGS. 1 and 2 show the exercising device in a first and second configuration respectively. The exercising device as illustrated may be referred to as a climber or stepper-type exerciser. The user is in an upright position with the user's feet on treadles which are synchronized to alternatingly move up and down to simulate a climbing or stepping exercise.

The exercising device of FIGS. 1 and 2 is hereinafter referred to as a stepper and generally denominated by the number 10. The stepper 10 has frame means for positioning on a support surface. The frame means as illustrated includes a base 12 with an upright section 14 secured to one end of the base 12. As can be seen, the upright portion 14 extends upwardly a preselected distance 16. The distance 16 is selected so the handles such as handles 18 and 20 are positioned for easy grasping by the upright user positioned on the levers 24 and 26.

As shown, the base 12 has a transverse portion 28 connected to the rearward end 30 of a centerpiece 32. The transverse member 28 is secured to the centerpiece 32 to provide transverse stability to the stepper 10. The centerpiece 32 in combination with the upright member 14 provides for axial stability of the stepper 10.

Figure 3:
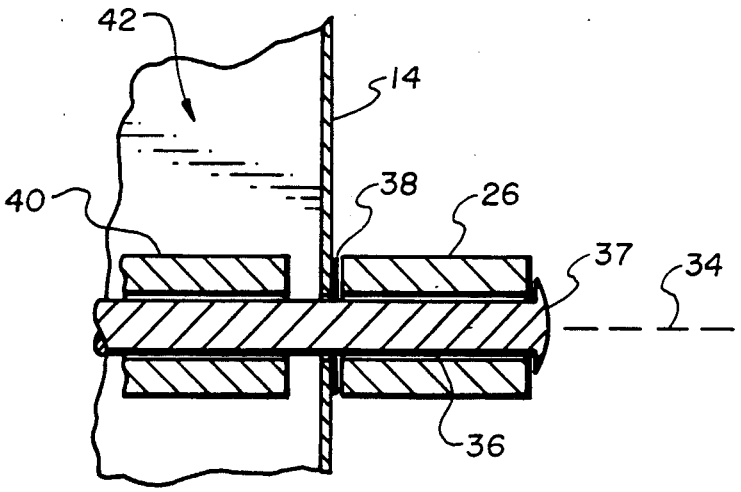
FIG. 3 is a partial cutaway depiction of a lever mounted to the frame of the exercising device of FIGS. 1 and 2.

As noted, the stepper 10 has a first lever means and a second lever means both pivotally mounted to the frame means and each operable by one foot of the user positioned in an upright position on the first and second lever means. As noted, the first and second lever means are here shown to include the levers 24 and 26. They are pivotally mounted to the upright portion 14 to pivot or rotate about axis 34. As shown in greater detail in FIG. 3, the lever 26 has an aperture 36 formed proximate one end. An axle 37 is sized to snugly but movably fit through the aperture 36 and into the upright member 14. A spacer or bushing 38 may be provided to space the lever 26 from the upright member 14. Interior to the upright member 14, an axle housing 40 is fixedly secured to support the axle 38. That is, the upright member 14 has an interior 42 within which the axle housing 40 is positioned. The axle housing 40 is preferably fixedly secured by welding or other convenient mechanical securing arrangements to the upright member 14.

Referring back to FIGS. 1 and 2, the stepper 10 has at least a first handle means for grasping by a user positioned on the first and second lever means in an upright position. The first handle means is positionable between a first configuration in which it is attached to the frame means and a second configuration in which it is attached to the first lever means for movement therewith.

As illustrated in FIGS. 1 and 2, the stepper 10 preferably has a second handle means for grasping by the user in the upright position which is also positionable between a first configuration and a second configuration as illustrated in FIGS. 1 and 2.

The handles 18 and 20 have an upper section 44 and 46 and a lower section 48 and 50. As illustrated, the handles 18 and 20 each have a handle section 52 and 54 which includes an appropriate material comfortable for grasping by the user. Selected rubber-like or neoprene type materials may be positioned on the handles 18 and 20, as illustrated. Notably, the handles 18 and 20 are attached to the frame means in a first configuration and to the lever means in a second configuration by attaching means.

As illustrated in FIG. 1, the handles 18 and 20 are secured to the upper end 56 of the upright member 14 to position the upper sections 44 and 46 for grasping by the user with the lower sections 48 and 50 extending downwardly, preferably to the transverse member 28 for attachment thereto. The upper end 56 of the upright member 14 has an aperture 58 formed therein sized to snugly but removably receive the upper end 60 of the handle 20. A similar aperture is formed in the upper end 56 of upright member 14 to receive the upper end 62 of handle 18. Preferably, the upper ends 60 and 62 of the handles 18 and 20 each have insert portions 64 and 66 formed therewith to snugly and removably mate or insert into the corresponding apertures such as aperture 58.

Similarly, an aperture 68 and aperture 70 are formed in the transverse member 28 to receive the lower ends 72 and 74 respectively of the lower sections 48 and 50 to constitute attaching means for attaching the handles 18 and 20 to the frame in the first configuration as shown in FIG. 1. The apertures 68 and 70 are sized to provide a snug fit to receive the lower ends 72 and 74 of the lower sections 48 and 50 of the handles 18 and 20.

In the second configuration, the handle 18 is removed from the first configuration and repositioned with the lower end 74 of the lower section 48 inserted in to a corresponding aperture 76 formed in the lever 26 as here shown proximate its forward end 78. The other lever 26 also has an aperture similar to aperture 76 formed therein but not here shown to receive the lower end 72 of handle 20. The lower end 74 of the handle 18 is inserted into the aperture 76 and secured therein by a securing screw 80 which has a handle portion for hand operation by the user. A similar screw arrangement is provided on the lever 24 to receive and secure the lower end 72 of handle 20.

Notably, the upper sections 44 and 46 of handles 18 and 20 are formed to be "L" shaped in projection with a first member 82 and 84 extending away from the frame means and more particularly the upper end 56 of the upright member 14. A second member 86 and 88 is secured to the first members 82 and 84 respectively to extend rearwardly. The lower sections 48 and 50 are secured to the second members 86 and 88 to extend downwardly as illustrated. In the first configuration with both a first handle 18 and a second handle 20 installed as illustrated, it can be seen that a "C"-shaped enclosure 90 is formed within which a user positioned on the levers 24 and 26 may perform exercises. The upper sections 44 and 46 are positioned with respect to the user for comfortable positioning of the user's hands at about what may be regarded as waist level. Thus, the user may grasp or hang on to the handles 18 and 20, and more particularly the handle sections 52 and 54 during the performance of stepping exercises on the levers 24 and 26.

In the second configuration, the handles 18 and 20 are removed and reinstalled as illustrated in FIG. 2 as discussed hereinbefore. Upon installation, the handles extend upwardly from the levers 24 and 26 to present the handle sections for ready grasp by the user positioned on the treadles on the levers 24 and 26. In operation, the user may then grasp the handle portions 52 and 54 and preferably the first member 82 and 84 of the upper sections 44 and 46 to simultaneously exercise the upper body, including the arms, while at the same time providing a handle for grasping to provide stability to the user during the performance of the exercises in the second configuration.

The stepper 10 of FIGS. 1 and 2 also includes resistance means mechanically connected to the levers 24 and 26 to resist movement and in turn increase the difficulty of the exercise and more particularly, the stepping exercises being performed by the user positioned on the levers 24 and 26 proximate their rearward ends 92 and 94. Also, the stepper 10 of FIGS. 1 and 2 includes synchronizing means which is interconnected between the first and second lever to synchronize movement of lever 24 with respect to lever 26. That is, as lever 24 moves in a downward direction 96, lever 26 moves in an upward direction 98. Similarly, as lever 26 moves in a downward direction 100, lever 24 moves in an upward direction 102. This synchronized or reciprocating movement presents the user with the stair climbing or stepping effect. That is, the user must operate the legs by bending the knees similar or comparable to the bending experienced when climbing stair or stepping.

Figure 4:
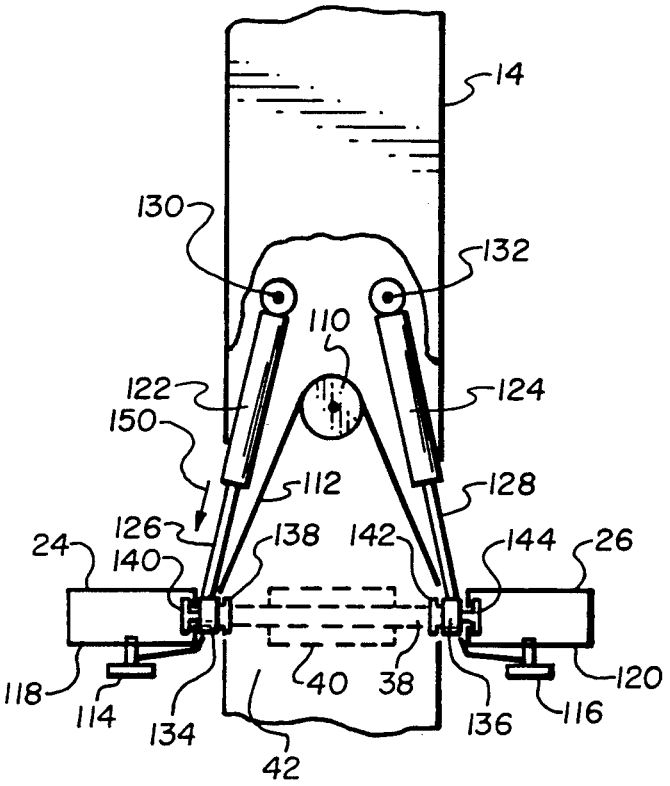
FIG. 4 is a simplified cutaway front view depiction of a portion of the exercising device of FIGS. 1 and 2.

FIG. 4 shows the synchronizing means to be a guide and more particularly, a pulley 110 mounted to the upright member 14 with a cable extending to and being secured to the levers 24 and 26 by threaded clamping screws 114 and 116 which are here shown threaded into the underside 118 and 120 of the levers 24 and 26 respectively. However, it should be understood that the cable 112 may be secured to the levers 24 and 26 in other ways so long as the levers 24 and 26 are securely fastened to the cable 112 to effect the synchronizing or reciprocating relationship between the levers 24 and 26 as hereinbefore discussed.

FIG. 4 also shows resistance means interconnected between the levers and the frame means. In particular, hydraulic resistance cylinders 122 and 124 are interconnected between the upright member 14 and the individual levers 24 and 26 as shown. The hydraulic cylinders 122 and 124 may be shock absorbers of the type used in other exercise equipment to resist movement of a lever or other object. That is, the hydraulic resistance cylinder 124 includes a piston with a hydraulic fluid therewithin and means to meter the fluid to either side of the piston. The piston is connected to a rod such as rods 126 and 128. Upon movement of the rods 126 and 128, resistance is effected by the hydraulic fluid as it is metered from one side to the other side of the internal piston as is known to those skilled in the art. As here shown, the hydraulic resistance cylinders 122 and 124 are secured to the frame means and more particularly the upright 14 by bolts 130 and 132 or similar fastening structure. The ends of the rods 126 and 128 are fastened to the levers 124 and 126 by appropriate means to resist movement of the levers. As it is here shown, the ends 134 and 136 of the piston rods 126 and 128 are secured by a bolt 138 interconnected to a bushing 140 with respect to lever 24 and by bolt 142 and bushing 144 for lever 26. The bushings 140 and 144 are positioned interior of a slot such as slot 146 illustrated in FIG. 5.

In use, the bolts 138 can be loosened to slide the end 134 of the piston rod 126 along the length 148 of the slot 146, thereby varying the mechanical leverage between the hydraulic cylinder 122 and the levers such as lever 24 and 26.

Figure 6:
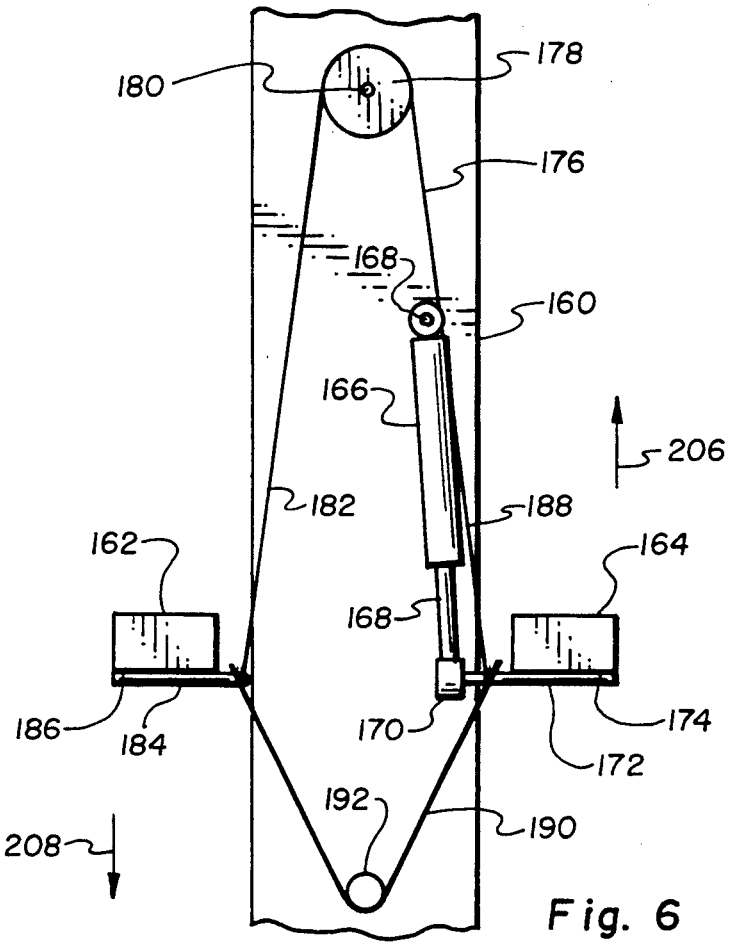
FIG. 6 is a simplified depiction of an alternative embodiment of the exercising device of the invention.

FIG. 6 shows an alternate configuration in which the upright member 160 of a stepper has levers 162 and 164 pivotally secured thereto, similar to the stepper 10 of FIGS. 1 and 2. Hydraulic resistance cylinder 166 is secured to the upright member 160 by a bolt 168 or similar fastening means. The cylinder 166 has a piston rod 168 with a connector 170 at the end thereof which is secured to and journaled to a pin 172 extending outwardly from the underside 174 of the lever 164. Synchronization or reciprocation is provided by a cable 176 which is trained around a guide such as pulley 178 rotatably mounted on an axle 180 to the upright member 160. The cable 176 has a first end 182 connected to a pin 184 which is fixedly secured to the underside 186 of lever 162. The other end 188 of the cable 176 is similarly fastened to a pin which is not clearly shown, but connected to the underside 174 of lever 164 in a fashion similar to that illustrated with respect to lever 162. A strap 190 is interconnected between the pin 184 on the underside of lever 162 and a similar pin on the underside 174 of lever 164. The strap 190 is trained around a guide 192 as more clearly seen in FIG. 7.

Figure 7:
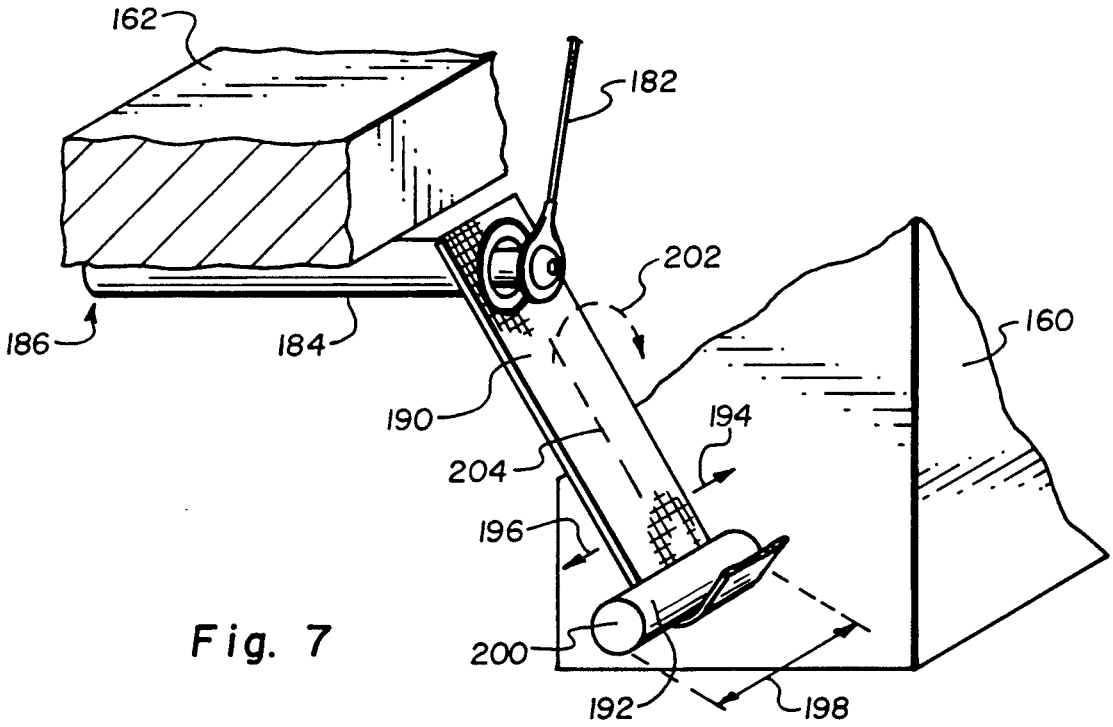
FIG. 7 is an enlarged perspective view of portions of FIG. 6.

Referring to FIG. 7, it can be seen that the strap 190 is trained under the guide 192. In operation, movement of the levers 162 and 164 in a reciprocating or upward and downward motion as described with respect to the stepper of FIGS. 1 and 2, results in some linear movement forwardly 194 and rearwardly 196 of the strap 190. The guide 192 is sized in length 198 so the levers 162 and 164 may move through their entire arc of travel without the strap 190 contacting the upright member 160 or sliding off the end 200 of the guide 192. The strap twists 202 around its longitudinal axis 204 due to the horizontal displacement between the pin 184 and the comparable pin (not shown) on the underside 174 of the lever 164 when the lever 164 is at its furthest upward 206 point of travel and the lever 162 is at its furthest downward 208 point of travel. Similarly, the strap twists when the lever 162 is at its upward point of travel and the lever 164 is at its downwardmost point of travel.

Figure 8:
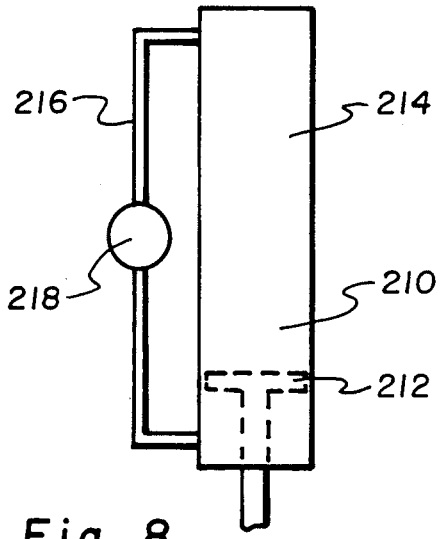
FIG. 8 is a simplified illustration of a hydraulic cylinder for use with the invention.

Referring to FIG. 8, an alternate hydraulic resistance cylinder 210 for use in lieu of the cylinder 166 in FIG. 6 is shown. The hydraulic cylinder 210 of FIG. 8 is of the type which has a piston 212 therewithin and a hydraulic fluid 214 is metered from one side the other side of the piston 212 through tubing 216. A valve 218 is provided in order to regulate the flow of hydraulic fluid 214 from one side to the other side of the piston 212 and in turn regulate the degree of resistance being imposed by the hydraulic cylinder 210 on movement of the levers such as levers 162 and 164 of FIG. 6.

Figure 9:
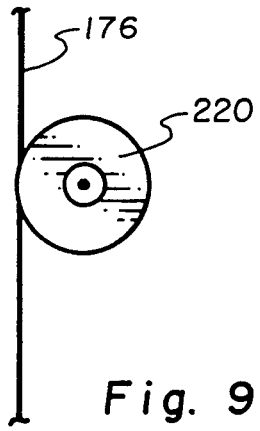
FIGS. 9 and 10 are simplified illustrations of part of the cable structure and resistance structure of an exercising device of the invention.
Figure 10:
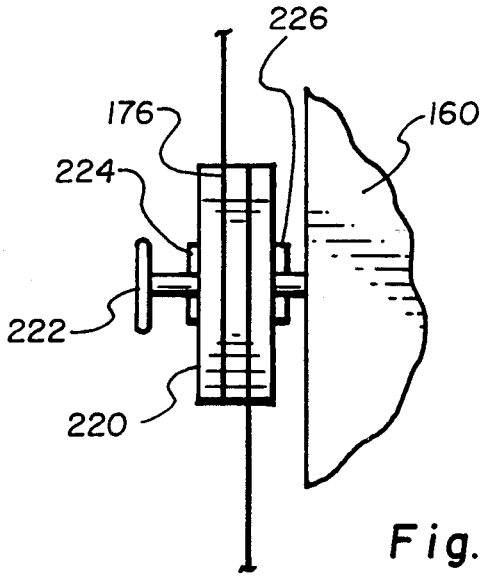

FIG. 9 shows an alternate resistance structure in which the cable 176 is trained around a resistance pulley 220 which is secured to the upright member 160 as shown more clearly in FIG. 10. Specifically, the pulley 220 has a track to receive the cable 176 for a full turn therearound as shown. A knob 222 is threaded into the upright member 160 to press the pulley 220 between a first compression member 224 and a second compression member 226 to increase or decrease the friction and resist rotation of the pulley and in turn movement of the cable 176. In turn, increased or decreased resistance is imposed to the movement of the levers 162 and 164.

Figure 5:
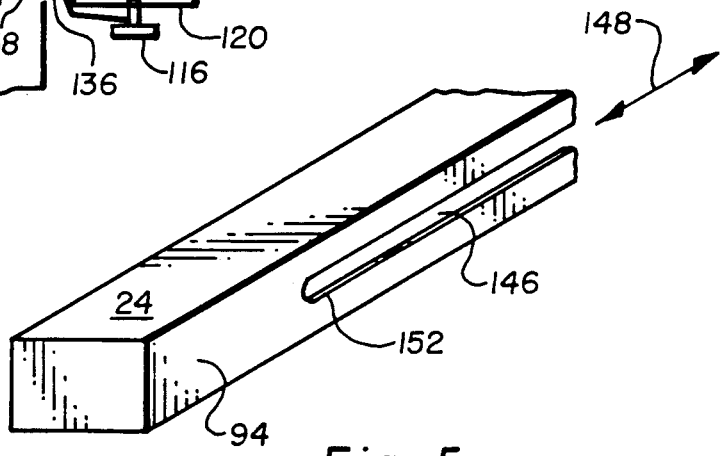
FIG. 5 is a partial perspective view of a lever of the exercising device of FIGS. 1 and 2.

In operation, it can be seen that a user mounts the stepper 10 of FIGS. 1 and 2 by placing one foot on lever 24 and the other foot on lever 26. The user may grasp the handles 18 and 20 of FIG. 1 while facing toward the upright member 14. The user may monitor various functions which are sensed and displayed on a console device 230. Non-skid material 232 is provided on lever 24 and lever 26 to minimize slipping of the user's feet. In operation, the user raises and lowers alternatingly the left and right knee to cause the levers 24 and 26 to move upwardly and downwardly which in turn reciprocate to provide the user with the benefits of a stepping or climbing-type exercise. As noted hereinbefore, the user may reposition the handles 18 and 20 to the configuration of FIG. 2 and grasp the handles to exercise the upper body at the same time the levers 24 and 26 are being operated by the feet. The degree of difficulty may be effected by imposing additional resistance and by varying the resistance means as illustrated in FIG. 4 and 5 as well as by resistance means as illustrated in FIG. 8 and FIG. 9 for the embodiments of FIG. 6 and 7.

It is to be understood that the details of the illustrated embodiment is not intended to limit the scope of the claims which themselves recite those features which applicants regard as essential to the invention.

What is claimed:

1. An exercising device comprising:

frame means for positioning on a support surface;

first lever means pivotably mounted to said frame means for movement by one foot of a user;

second lever means pivotably mounted to said frame means and spaced from said first lever means for movement by the other foot of a user in an upright position on said first lever means and second lever means;

resistance means connected to the frame means and to said first lever means and said second lever means to resist movement of each of said lever means; and first handle means for grasping by said user in said upright position, said first handle means being positionable in a first configuration in which said first handle means is attached to said frame means and in a second configuration in which said first handle means is attached to said first lever means for movement therewith.

2. The exercising device of claim 1 further including second handle means for grasping by said user in said upright position, said second handle means being positionable in a first configuration in which said second handle means is attached to said frame means and in a second configuration in which said second handle means is attached to said second lever means for movement therewith.

3. The exercising device of claim 1, further including synchronizing means connected to and between said first lever means and said second lever means for causing synchronized movement of said first lever means with respect to said second lever means.

4. The exercising device of claim 3 wherein said synchronizing means includes guide means secured to said frame means, cable means having one end secured to said first lever means and its other end secured to said second lever means, said cable means extending over said guide means.

5. The exercising device of claim 3 wherein said resistance means includes a first hydraulic resistance cylinder interconnected between said first lever means and said frame means and a second hydraulic resistance cylinder interconnected between said second lever means and said frame means.

6. The exercising device of claim 5 further including first attaching means for adjustably attaching said first hydraulic resistance cylinder to said first lever means and second attaching means for adjustably attaching said second hydraulic resistance cylinder to said second lever means, said first and said second attaching means each being adjustable to vary the resistance to movement by the respective first and second resistance cylinder.

7. The exercising device of claim 6 wherein said first and said second attaching means are each slots formed in said first lever means and said second lever means respectively and coacting means associated with said first and said second hydraulic resistance cylinders respectively to move along the length of said slots.

8. The exercising device of claim 2, wherein said first handle means and said second handle means each include a handle section for grasping by the user in said second configuration.

9. The exercising device of claim 8 wherein said first and said second lever means are treadles.

10. The exercising device of claim 8 wherein said first and said second handle means are each attached to said frame means in said first configuration and to said first and said second lever means in said second configuration by first and second handle attaching means respectively.

11. The exercising device of claim 10 where said first and said second handle attaching means each include a recess formed in said frame means and a recess formed in said first lever means and said second lever means respectively, and a first end insert section and a second end insert section formed at each end of said first handle means and said second handle means respectively, said first and said second end insert sections being sized to snugly and removably insert into each of said recesses.

12. The exercising device of claim 1 wherein said first handle means has an upper section and a lower section, wherein in said first configuration, said upper section of said first handle means has a first member which extends away from said frame means and a second member connected to said first member and extends toward said user in said upright position for grasping by said user, said lower section extending downwardly from said second member.

13. An exercising device of claim 12 wherein said upper section is "L" shaped in projection with upper connection means at one end to interconnect to said frame means in said first configuration.

14. The exercising device of claim 13 wherein said lower section is connected to the other end of said upper section and extends downwardly to a lower end having lower connection means for connection to said first lever means.

15. The exercising device of claim 14 wherein said upper connection means and said lower connection means include recesses formed in said frame means sized to snugly receive the one end of said upper section and the lower end of said lower section, respectively.

16. The exercising device of claim 15 wherein said first lever means has a lever recess sized to snugly receive the lower end of said lower section.

17. The exercising device of claim 16 wherein said second handle means has an upper section an a lower section, wherein in said first configuration said upper section is "L" shaped in projection to form a "C"-shaped enclosure for said user in said upright position.

18. The exercising device of claim 16 wherein the second member of said "L"-shaped section extends downwardly from the first member.

19. The exercising device of claim 3 wherein said resistance means includes a hydraulic cylinder having a piston therein with a channel interconnecting the interior of the cylinder on both sides of said piston, said channel having a valve positioned therein to meter the flow of fluid therethrough.

20. The exercise device of claim 3 wherein said synchronizing means includes a first guide secured to said frame means above said first and second lever means, a second guide secured to said frame means below said first and second lever means, a cable trained around said first and said second guides to have a first stretch proximate said first lever means and a second stretch proximate said second lever means, said first and said second lever means being connected to said first and second stretches respectively.

21. The exercise device of claim 20 wherein said resistance means includes a friction pulley secured to said frame means with means to vary the rotation thereof, said cable being trained about said friction pulley.

22. The exercise device of claim 21 wherein said first guide means is said friction pulley.

23. The exercise device of claim 20 wherein said cable has a lower portion interconnected between said first lever means and said second lever means, said lower portion being a strap.

24. A multi-purpose exercising device comprising:

frame means for positioning on a support surface;

first and second lever means movably mounted to said frame means for operation by a user in an upright position thereon;

resistance means connected to the frame means and to said first and said second lever means to resist movement of said first and second lever means; and first and second handlebars having first and second ends, said handlebars being removably positioned in either a first position wherein said upper ends of said first and said second handlebars are removably attached to said frame means, said first and second handlebars being shaped and positioned to form a "C"-shaped enclosure for said user in said upright position, or a second position wherein said lower ends of said first and second handlebars are attached to said lever means to be movable upon movement of said lever means.

25. The exercise device of claim 24 further including synchronizing means connected to and between said first lever means and said second lever means for causing synchronized movement of said first lever means with respect to said second lever means.

26. The exercise device of claim 25 wherein said synchronizing means includes a first guide secured to said frame means above said first and second lever means, a second guide secured to said frame means below said first and second lever means, a cable trained around said first and said second guides to have a first stretch proximate said first lever means and a second stretch proximate said second lever means, said first and said second lever means being connected to said first and second stretches respectively.

27. The exercise device of claim 26 wherein said cable has a lower portion interconnected between said first lever means and said second lever means, said lower portion being a strap.

* * * * *